United States Patent [19]

Hollister et al.

[11] 4,043,058

[45] Aug. 23, 1977

[54] ATHLETIC TRAINING SHOE HAVING FOAM CORE AND APERTURED SOLE LAYERS

[75] Inventors: Geoffrey L. Hollister; Dennis E. Vixie, both of Eugene, Oreg.

[73] Assignee: BRS, Inc., Beaverton, Oreg.

[21] Appl. No.: 688,843

[22] Filed: May 21, 1976

[51] Int. Cl.[2] ..... A43B 1/10; A43B 13/18; A43C 15/00

[52] U.S. Cl. ..... 36/102; 36/28; 36/67 A

[58] Field of Search ..... 36/3 R, 3 B, 28, 30 R, 36/32 R, 67 A, 43, 44, 102, 114, 129, 37, 35 R

[56] References Cited

U.S. PATENT DOCUMENTS

| | | | |
|---|---|---|---|
| 2,034,243 | 3/1936 | Maxwell | 36/108 |
| 2,410,019 | 10/1946 | Davis | 36/28 |
| 2,527,414 | 10/1950 | Hallgren | 36/28 |
| 2,981,011 | 4/1961 | Lombardo | 36/28 |
| 3,793,750 | 2/1974 | Bowerman | 36/59 C |
| 3,984,926 | 10/1976 | Calderon | 36/37 |

*Primary Examiner*—Patrick D. Lawson
*Attorney, Agent, or Firm*—Klarquist, Sparkman, Campbell, Leigh, Hall & Whinston

[57] ABSTRACT

A straight last athletic training shoe is described employing a foam core sole layer and an apertured sole layer between a harder outer sole layer and the shoe upper. The apertured sole layer provides lightweight cushioning and is preferably a heel lift layer positioned below an intermediate sole layer having a soft resilient foam core surrounded by a border portion of harder resilient material for stability. The foam core is provided within an elongated opening extending longitudingly beneath the heel, arch and metatarsal bones of the wearer's foot for greater cushioning and support. The apertures in the heel lift layer are arranged in three longitudinal rows with at least some apertures being in alignment with the foam core of the intermediate sole layer and the middle row having apertures which are staggered out of alignment with the apertures of the outer two rows.

26 Claims, 8 Drawing Figures

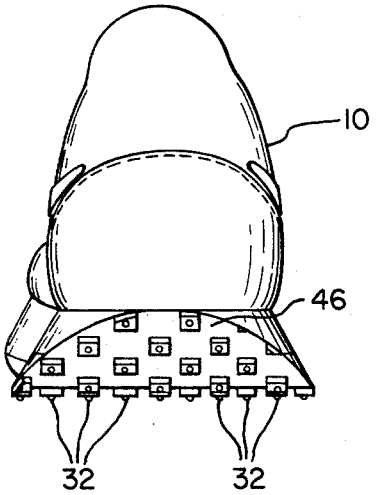
FIG. 3
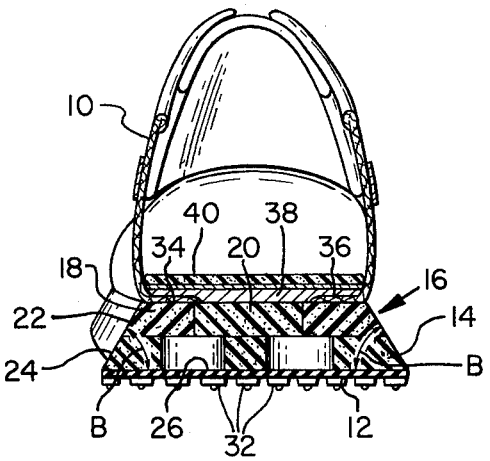
FIG. 4
FIG. 5
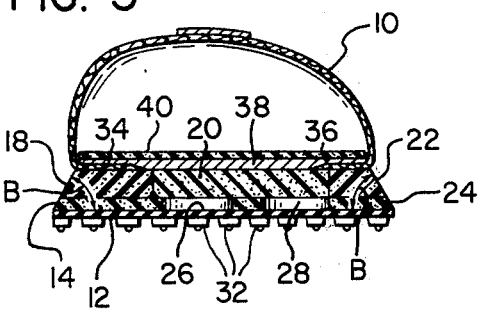
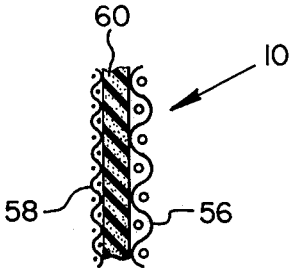
FIG. 6
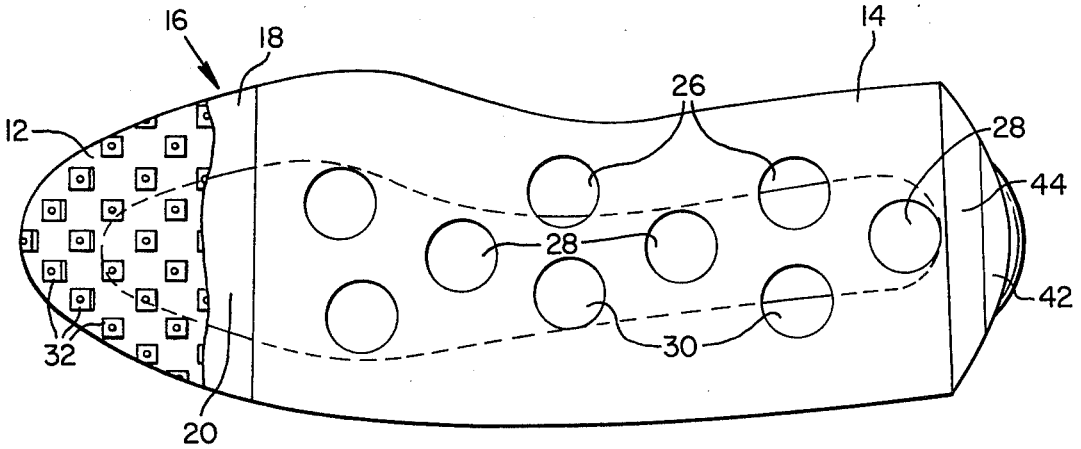
FIG. 7

ATHLETIC TRAINING SHOE HAVING FOAM CORE AND APERTURED SOLE LAYERS

BACKGROUND OF INVENTION

The subject matter of the present invention relates generally to athletic shoes and in particular to athletic shoes having multi-layered soles including an apertured sole layer and/or a foam core sole layer positioned between a harder, wear resistant outer sole layer and the shoe upper.

In the preferred embodiment, the apertured sole layer is a heel lift layer positioned below an intermediate sole layer having a softer resilient foam core surrounded by a harder resilient border portion and provided within an elongated opening extending longitudinally beneath the heel, arch and metatarsal bones of the wearer's foot for greater comfort and support. The shoe is built on a straight last and is provided with flared sides on the intermediate sole layer and heel lift layer for greater lateral stability along with a flat planar beveled heel which insures proper foot position during initial contact with the ground, sometimes called "heel strike." This insures proper foot placement from heel strike to toe off. The shoe of the present invention is especially useful as a training shoe for running, exercise and conditioning, since it prevents injury to the foot and leg.

Previously it has been proposed in spike track shoes used by jumpers, to provide an aperture in the heel lift sole layer for cushioning the heel, as shown in U.S. Pat. No. 3,290,801 of Bente, granted Dec. 13, 1966. However, such shoes employed a single opening in the heel lift layer of a sufficient size to receive the downward projection of the heel bone of the foot to prevent injury to the heel of the jumper. It is also old to provide conventional street shoes with an apertured middle sole for ventilation, as shown in U.S. Pat. No. 231,398 of Bussey, granted Aug. 24, 1880 and U.S. Pat. No. 3,050,875 of Robbins, granted Aug. 28, 1962. Unlike the present invention, a plurality of apertures arranged in three staggered rows are not provided in the heel lift layer to provide both support and cushioning. In addition, there is no intermediate sole layer provided above the heel lift layer which contains a softer resilient foam core within an elongated opening extending beneath the heel, arch and metatarsal bones of the foot as is employed in the training shoe of the present invention. Furthermore, there is no indication that such athletic shoe should be made with a straight last. However, it should be noted that conventional street shoes have previously been made with straight lasts, as shown in U.S. Pat. No. 2,034,243 of Maxwell, granted Mar. 17, 1936.

Previously it has been proposed in U.S. Pat. No. 3,793,750 of Bowerman to provide an athletic shoe with a nylon fabric upper and cushion middle sole layer covered by a harder outer sole including polygon-shaped studs. Athletic shoes have also been made with flared sides and beveled rear heel surfaces. Unlike the present invention, such athletic shoes were not provided with an apertured heel lift layer or an intermediate sole layer having an inserted core of softer foam cushioning. These sole layers give the athletic shoe of the present invention the advantages of excellent comfort and support, while at the same time providing a relatively lightweight shoe of long useful lifetime and good traction.

SUMMARY OF INVENTION

It is therefore one object of the present invention to provide an improved athletic shoe having intermediate sole layers which provide better cushioning, comfort and support.

Another object of the invention is to provide such a shoe of good lateral stability which guides the foot at the time of initial contact by the heel of the shoe with the ground and during continued contact of the bottom of the sole until final contact by the toe of the shoe with the ground in order to prevent injury by insuring proper foot placement during running even when the wearer is fatigued.

A further object of the invention is to provide such a shoe as a training shoe which is relatively lighter in weight and has a long useful lifetime while at the same time providing good traction.

An additional object of the present invention is to provide such an athletic shoe employing an apertured heel lift layer and an intermediate sole layer having a core insert of soft foam cushioning material provided within an opening extending beneath the heel, arch, and metatarsal bones of the foot and in communication with at least some of the apertures in such heel lift layer.

Another object of the invention is to provide such a shoe in which the heel lift layer and the intermediate sole layer are covered by an outer sole layer of harder, resilient, wear-resistant material which may have polygon-shaped studs molded in its outer bottom surface.

Still another object of the invention is to provide such an athletic shoe in which the intermediate sole layer and the heel lift layer are provided with side surfaces which flare outwardly and are provided with inwardly slanting rear heel surfaces forming a flat planar beveled heel.

A still further object of the invention is to provide such a shoe in which the shoe upper and sole is in the shape of a straight last for greater comfort and prevention of injury.

BRIEF DESCRIPTION OF DRAWINGS

Other objects and advantages of the present invention will be apparent from the following detailed description of a preferred embodiment thereof and from the attached drawings of which:

FIG. 3 is a rear elevation view of the shoe of FIGS. 1 and 2;

FIG. 4 is a vertical section view taken along the line 4—4 of FIG. 2;

FIG. 5 is a vertical section view taken along the line of 5—5 of FIG. 2;

FIG. 6 is an enlarged vertical section view of the shoe upper taken along the line 6—6 of FIG. 1;

FIG. 7 is a bottom elevation view of the shoe of FIG. 1 with parts broken away for clarity to show the internal construction of the sole layer.

DESCRIPTION OF PREFERRED EMBODIMENT

Figure 1:
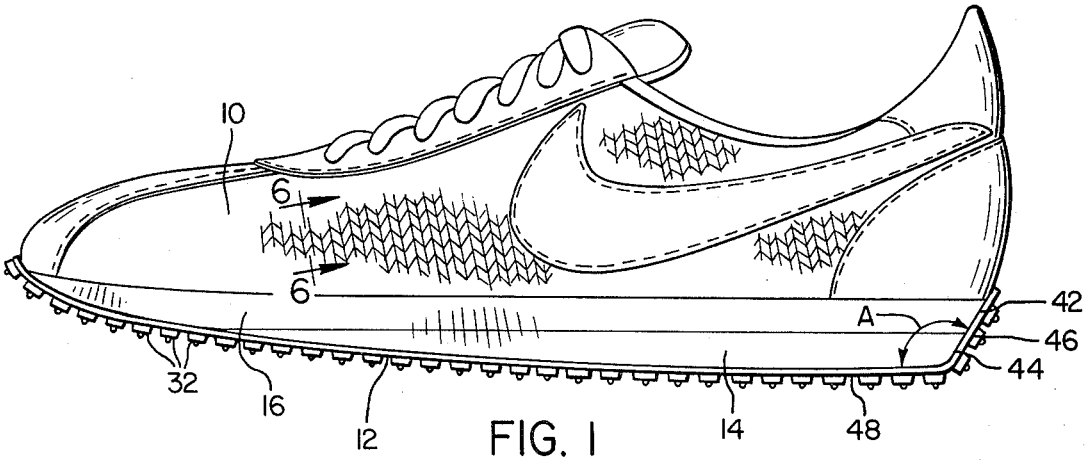
FIG. 1 is a side elevation view of a shoe in accordance with the preferred embodiment of the present invention.
Figure 2:
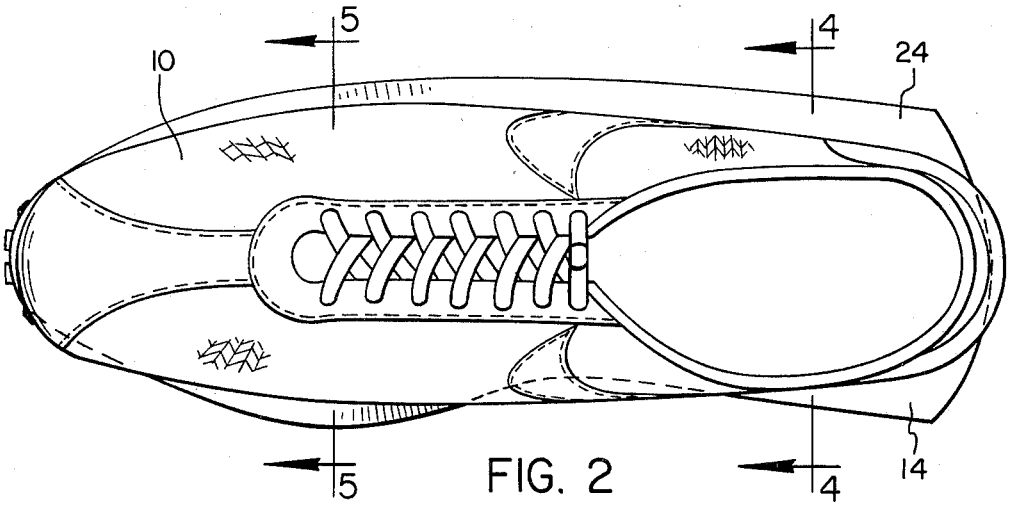
FIG. 2 is a top elevation view of the shoe of FIG. 1.

As shown in FIG. 1, one embodiment of the athletic shoe of the present invention includes a shoe upper 10 of leather or synthetic plastic fabric, such as nylon, secured to a multilayered sole including an outer sole layer 12 of hard resilient wear-resistant rubber material, an apertured heel lift layer 14 of resilient lightweight foam cushioning material and an intermediate sole layer 16 of similar cushioning material but having a softer foam core for greater cushioning, as hereafter described. The heel lift layer 14 is preferably positioned between the intermediate sole layer 16 and the outer sole layer 12, such heel lift layer extending longitudinally beneath the heel, arch and metatarsal bones of the foot of the wearer, while the intermediate layer extends the full length of the foot. However, it is also possible to reverse the positions of the heel lift layer 14 and intermediate sole layer 16 in some instances. The heel lift layer 14 is of approximately the same maximum thickness of about ¼ inch as the intermediate sole layer 14 in the heel area, as shown in FIG. 4, but such heel lift tapers to a smaller thickness under the arch and metatarsal bones until it terminates slightly in front of the metatarsal heads.

The intermediate sole layer 16 includes an outer border portion 18 extending around the rim of the intermediate sole layer and surrounding a softer foam inner core 20. The foam core 20 has a substantially flat continuous upper surface and is contained within a single elongated opening passing through the intermediate sole layer and extending longitudinally beneath the heel, arch and toes of the foot for cushioning. The border portion 18 of harder foam material is provided with flared side surfaces 22 on opposite sides of the sole which flare downwardly and outwardly. Each of the flared side surfaces 22 is aligned with a similar flared surface 24 on the side of the heel lift layer 14, as shown in FIG. 4. Thus, the two flared side surfaces 22 and 24 are aligned and form an acute included angle B with the top surface 26 of the bottom portion of the outer sole layer 12 normally engaging the ground. The flare angle B is in the range of 45° to 75° and is preferably about 60°. The flared sides 22 and 24 of sole layers 16 and 14 provide the shoe with greater lateral stability to prevent sprained ankles and other injuries to the foot. In order to achieve this lateral stability, the border portion 18 of the intermediate sole layer and the entire heel lift layer 14 are made of a relatively hard, dense, resilient foam material, such as a closed cell synthetic or natural foam rubber including polyisoprene microcellular sponge rubber, having a density of about 42 lbs./cu. ft. at a temperature of 76° F. and a hardness of about 42 to 46 durometer, A-type, at 68° F. It should be noted that the hardness and density values were obtained by the standard tests A.S.T.M. D2240 and A.S.T.M. D1565 of the American Society of Testing and Materials. Also to provide greater cushioning, the intermediate sole layer 16 is also provided with the inner core 20 of a softer, lower density, resilient, closed cell foam material, such as a synthetic plastic of polyethylene of ethylene vinyl acetate copolymer, whose cells may be filled with nitrogen or other foaming gas. The ethylene vinyl acetate core may have a density of 8.3 lbs./cu. ft. at 76° F. and a hardness of 26 to 29 durometer, A-type, at 68° F., while the polyethylene core may have a density of 2.4 lbs./cu. ft. at 76° and a hardness of 11 durometer, A-type, at 68° F. However, other synthetic plastic or rubber foam materials can be employed for sole elements 14, 18 and 20.

Figure 8:
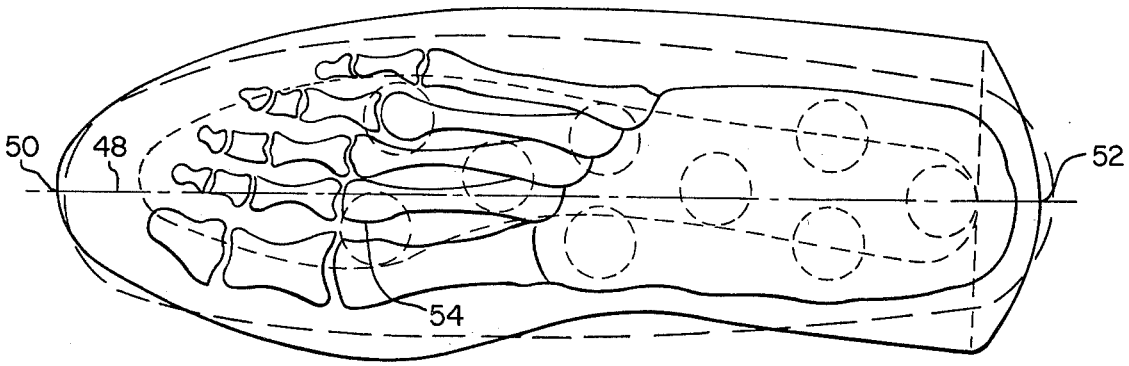
FIG. 8 is a diagrammatic view looking down on the top of the shoe of FIG. 2, showing the foot of the wearer within such shoe.

The apertured heel lift layer 14 is provided with three rows of apertures 26, 28 and 30 which extend longitudinally along such layer. The middle row of apertures 28 is staggered out of alignment with the apertures of the outer two rows of apertures 26 and 30. The back aperture in the middle row of apertures 28 is closest to the rear of the heel portion of the shoe while the two front apertures of the outer two rows of apertures 26 and 28 are closest to the front of the heel wedge portion and overly the heads of the metatarsal bones of the foot, as shown in FIG. 8, for greater comfort and cushioning. At least some of the apertures, including the entire middle row 28, are in alignment with the foam core 20 of the intermediate layer, such apertures extending completely through the heel lift layer into communication with the foam core. It should be noted that the apertures are circular, have a diameter in the range of ½ to 1 inch, preferably about ¾ inch diameter which is greater than the maximum thickness of the heel lift layer 14, and have a longitudinal spacing between adjacent apertures in the same row of approximately twice the diameter of the apertures or 1½ inches for the preferred size, as shown in FIG. 7. In this case the rows 26, 28 and 30 consist of three apertures each.

As shown in FIGS. 1, 3 and 7, the outer sole layer 12 includes a plurality of polygon-shape studs 32 extending downwardly from the lower surface of the outer sole layer and formed of hard rubber molded integrally therewith, such as shown in U.S. Pat. No. 3,793,750 referred to previously. These studs provide the shoe with good traction and additional cushioning. Of course, the outer sole is made of a harder, more wear-resistant rubber or other resilient material, than the cushioning layers 14 and 16. This outer sole of about ⅛ inch thickness is thinner and harder than the cushioning layers 14 and 16 and can be replaced when such outer sole layer wears out.

The outer sole layer, the heel lift layer and the intermediate sole layer are bonded together in a conventional manner by a waterproof glue such as rubber cement or other suitable bonding material. In addition, the top surface of the boundary portion 18 of the intermediate sole layer 16 is bonded to a pair of inner edges 34 and 36 of the shoe upper, as shown in FIG. 4. An inner platform layer 38 of fiberboard or cardboard provided within the shoe is similarly bonded over the edges 34 and 36 of the upper, and is also bonded over the foam core 20 of the intermediate sole layer. A resilient foam insole layer 40, such as closed cell Neoprene foam rubber, having a fabric bonded to its upper surface, is provided within the shoe over this platform layer to prevent blisters on the foot.

Flat, planar heel surfaces 42 and 44 are provided at the rear ends of the intermediate sole layer 16 and the heel lift layer 14, as shown in FIGS. 1 and 7. These planar heel surfaces are aligned to form a beveled heel which slants downwardly and inwardly to form an obtuse, included angle A of preferably about 120° with the upper surface of the bottom portion of the outer sole layer 12 which normally engages the ground when the wearer is standing still. The outer sole layer 12 includes an upper portion 46 which extends up from the bottom portion over the beveled heel surfaces 42 and 44 to cover the beveled heel, as shown in FIG. 3. The beveled heel insures proper foot placement during initial contact with the ground, sometimes called "heel strike," while the flared sides 20 and 24 of the sole layers provide lateral stability and maintain the bottom of the sole on the ground until final contact with the ground by the toe of the shoe, sometimes called "toe off." This, together with the cushioning and support of the foot by the heel lift layer and the intermediate sole layer, prevent injury to the wearer's foot and leg. Such guiding of the shoe to insure proper foot position at all times, as well as provide support for the arch and cushioning for the entire foot, is extremely important when running long distances such as during training because when a runner becomes fatigued his foot placement tends to become sloppy.

Another feature which helps achieve good comfort and proper foot position is the straight last of the shoe, as shown in FIG. 8. The shoe upper and sole layers are formed on a straight last, having a last axis 48 which extends between the forward most point 50 and the rearward most point 52 of the sole. This last axis 48 corresponds to the weight bearing line of the foot and extends along a line which bisects the heel of the foot and passes through the second metatarsal head 54. This straight last axis passes along the second metatarsal bone and in this regard is different from the last axis shown in FIG. 1 of the U.S. Pat. No. 2,034,243, referred to above.

As shown in FIG. 6, the shoe upper 10 may be made of a multiple layer fabric including an outer layer 56 of nylon fabric of open mesh, an inner layer 58 of a different synthetic fabric of closed mesh and a middle layer 60 of open cell, synthetic foam such as polyurethane. This multiple layer fabric is strong, comfortable and provides good air ventilation. The inner layer 60 prevents small cinders, rocks or other objects from passing through the fabric which might otherwise be transmitted through the outer layer 56 because of the smaller mesh openings in the inner layer.

It will be obvious to those having ordinary skill in the art that changes may be made in the above described preferred embodiment without departing from the spirit of the invention. For example, the front end of the heel lift layer 14 could terminate at or behind, rather than in front of, the metatarsal heads to provide greater sole flexibility at the metatarsal joint. Also, it should be understood that while the shoe of the present invention prevents injury in the sense that it greatly reduces the chance of injury, no shoe can eliminate all injury. Therefore, the scope of the present invention should be determined by the following claims.

We claim:

1. An athletic shoe comprising:

a shoe upper;

an outer sole including a ground engaging bottom surface under the heel, toe and arch portions of said shoe;

an intermediate sole layer provided between said outer sole and said upper, said intermediate sole layer including an outer border portion of resilient material surrounding an inner core portion of softer and less dense resilient synthetic foam material than said border portion provided within an opening through said intermediate layer and extending along the length of the shoe so that said foam core is positioned beneath the heel, arch and toe portions of said shoe;

an apertured heel lift sole layer of resilient material provided between said outer sole and said upper and positioned beneath the heel portion, said heel lift layer including a plurality of apertures extending completely through the heel lift layer, said apertures being of a width greater than the maximum thickness of said heel lift layer, and having at least some of said apertures in alignment with said inner core in said intermediate sole layer.

2. An athletic shoe in accordance with claim 1 in which the apertures in the heel lift layer are arranged in at least three longitudinal rows with the apertures of the middle row being staggered so they are not aligned with those of the two outer rows.

3. An athletic shoe in accordance with claim 2 in which the aperture at the back end of the middle row is positioned at the rear of the heel as the last aperture of the heel lift layer.

4. An athletic shoe in accordance with claim 1 in which the heel lift layer is provided beneath the middle sole layer.

5. An athletic shoe in accordance with claim 4 in which the heel lift layer extends beneath the arch of the foot and is tapered in thickness.

6. An athletic shoe in accordance with claim 1 in which the outer sole is thinner and of harder resilient material than the middle sole layer.

7. An athletic shoe in accordance with claim 6 in which the outer sole has polygon shaped studs extending downward from the bottom thereof and formed integral with the outer sole.

8. An athletic shoe in accordance with claim 1 in which the shoe upper is made of a synthetic plastic fabric.

9. An athletic shoe in accordance with claim 8 in which the fabric includes a nylon mesh outer layer of large mesh openings and an inner fabric layer of smaller mesh openings.

10. An athletic shoe in accordance with claim 1 in which the rear ends of the intermediate sole layer and the heel lift layer have flat planar surfaces which extend at an included obtuse angle to the upper surface of the bottom portion of the outer sole to form a beveled heel portion which is covered by a top portion of said outer sole layer.

11. An athletic shoe in accordance with claim 10 in which the obtuse angle of the beveled heel is substantially 120°.

12. An athletic shoe in accordance with claim 1 in which the sides of the intermediate sole layer and the heel lift layer flare outward and downward to form an included acute angle with the upper surface of the bottom portion of the outer sole in the range of 45° to 75°.

13. An athletic shoe in accordance with claim 12 in which the acute angle is substantially 60°.

14. An athletic show in accordance with claim 1 in which the shoe upper and the sole layers are formed of a straight last shape whose last axis bisects the heel as it passes through the second metatarsal head of the wearer's foot.

15. An athletic shoe comprising:

a shoe upper;

an outer sole layer including a ground engaging bottom surface under the heel, toe and arch portions of said shoe; a heel lift sole layer of resilient material provided between said outer sole and said upper; and an intermediate sole layer secured between said outer sole layer and said upper, said intermediate sole layer including an outer border portion of resilient material separate from the outer sole and surrounding an inner core portion provided by a foam member made of softer and less dense resilient foam material than said border portion provided within an opening completely through said intermediate layer, said core portion having a substantially flat continuous upper surface, and extending longitudinally of the shoe so that said core is positioned beneath the heel, arch, and metatarsal bones of the wearer's foot.

16. An athletic shoe in accordance with claim 15 in which the shoe upper and the sole layers are formed of a straight last shape whose last axis passes along the second metatarsal bone of the wearer's foot.

17. An athletic shoe in accordance with claim 15 in which the inner core portion of the intermediate layer is made of closed cell synthetic plastic foam taken from the group consisting of polyethylene and ethylene vinyl acetate copolymer.

18. An athletic shoe in accordance with claim 17 in which said heel lift layer is provided between the intermediate sole layer and the outer sole layer, and the border portion and the heel lift layer are made of crepe rubber foam.

19. An athletic shoe comprising:

a shoe upper;

an outer sole layer;

an apertured sole layer of resilient material provided between said outer sole and said upper, said apertured sole layer having a plurality of apertures extending completely through said apertured layer and arranged in at least three rows extending longitudinally of said shoe with the apertures of the middle row being staggered so that they are not aligned with those of the outer two rows; and said shoe upper and sole layers being formed with a straight last shape.

20. A shoe in accordance with claim 19 in which the axis of the straight last bisects the heel and passes along the second metatarsal bone of the wearer's foot.

21. A shoe in accordance with claim 19 in which the apertured sole layer is a heel lift layer separated from the shoe upper by a middle sole layer.

22. A shoe in accordance with claim 19 in which the middle row of apertures has an aperture at the back end thereof which is positioned at the rear of the heel as the last aperture in the apertured sole layer.

23. A shoe in accordance with claim 19 in which the outer sole layer is thinner and of harder resilient material than the apertured layer.

24. A shoe in accordance with claim 23 in which the outer sole has polygon shaped studs extending downward from the bottom thereof which are formed integral with the outer sole.

25. A shoe in accordance with claim 19 in which the apertures are substantially circular and have a diameter in the range of $\frac{1}{2}$ inch to 1 inch.

26. A shoe in accordance with claim 19 in which the apertures are substantially circular with a diameter of about $\frac{3}{4}$ inch.

* * * * *

UNITED STATES PATENT OFFICE

CERTIFICATE OF CORRECTION

Patent No. 4,043,058 Dated August 23, 1977

Inventor(s) Geoffrey L. Hollister; Dennis E. Vixie

It is certified that error appears in the above-identified patent and that said Letters Patent are hereby corrected as shown below:

Column 5, line 60, claim 1, after "shoe;" insert --and--.

Column 6, line 49, claim 14, "show" should be --shoe--.

Signed and Sealed this

*Twenty-second* Day of *November 1977*

[SEAL]

*Attest:*

RUTH C. MASON
*Attesting Officer*

LUTRELLE F. PARKER
*Acting Commissioner of Patents and Trademarks*